US010737193B1

(12) United States Patent
Norman

(10) Patent No.: US 10,737,193 B1
(45) Date of Patent: Aug. 11, 2020

(54) NOVELTY POP-UP TOY ASSEMBLY

(71) Applicant: Genie Toys plc, Cheltenham (GB)

(72) Inventor: Casey W. Norman, Gloucestershire (GB)

(73) Assignee: Genie Toys plc, Cheltenham (GB)

( * ) Notice: Subject to any disclaimer, the term of this patent is extended or adjusted under 35 U.S.C. 154(b) by 0 days.

(21) Appl. No.: 16/552,196

(22) Filed: Aug. 27, 2019

(51) Int. Cl.

| | |
|---|---|
| ***A63H 13/10*** | (2006.01) |
| ***A63H 33/00*** | (2006.01) |
| ***A63H 37/00*** | (2006.01) |
| *A63H 17/26* | (2006.01) |
| *A63H 11/06* | (2006.01) |

(52) U.S. Cl.
CPC ..... *A63H 37/005* (2013.01); *A63H 11/06* (2013.01); *A63H 17/26* (2013.01)

(58) Field of Classification Search
CPC ..... A63H 37/005; A63H 11/06; A63H 27/14; A63H 33/003
USPC ..... 446/72, 308, 309, 310, 311, 385, 486
See application file for complete search history.

(56) References Cited

U.S. PATENT DOCUMENTS 3,108,395 A 12/1960 Goldfarb et al.
3,218,071 A * 11/1965 Richard ..... A63B 43/00 473/594
3,526,991 A 1/1969 Goldfarb et al.
5,162,013 A * 11/1992 von Mohr ..... A63H 3/12 446/183
5,213,538 A * 5/1993 Willett ..... A63H 3/003 446/308
7,803,033 B1 * 9/2010 Walterscheid ..... A63H 37/005 446/308
7,806,746 B2 10/2010 Walterscheid
7,927,177 B1 * 4/2011 Walterscheid ..... A63H 37/005 446/308
D637,239 S 5/2011 Walterscheid
D641,433 S 7/2011 Walterscheid
8,371,899 B1 * 2/2013 Walterscheid ..... A63H 11/06 446/308
2002/0164921 A1 * 11/2002 Wilkinson ..... A63H 11/06 446/308

(Continued)

OTHER PUBLICATIONS

3 X Jumpz (Colors Vary), https://zing.store/collections/ages/products/3-x-jumpz-colors-vary.

(Continued)

*Primary Examiner* — Nini F Legesse
(74) *Attorney, Agent, or Firm* — DLA Piper LLP (US)

(57) ABSTRACT

A pop-up toy assembly includes a head portion having a cap portion with an interior space, a base portion, a mesh tubing having a top end portion and a bottom end portion narrower than the top end portion, and a latching mechanism, wherein the top end portion is attached to an interior surface of the interior space of the head portion and the bottom end portion is attached to the base portion, the mesh tubing is configured to invert inwards when a compress force is applied to move the assembly from an uncompressed state to a compressed state, and the latching mechanism is configured to latch the head portion and the base portion in a compressed state and, upon impact with another object, the latching mechanism is configured to unlatch from the compressed state and spring back to the uncompressed state with enough force to propel the assembly away from the another object.

20 Claims, 6 Drawing Sheets

(56) References Cited

U.S. PATENT DOCUMENTS

2014/0349546 A1* 11/2014 Walterscheid ..... A63H 13/16
446/310

OTHER PUBLICATIONS

Fiaya Emoji Fly Man Jump Bounce Elf Jump Doll Funny Colorful Toys Kids Gift, https://www.amazon.com/Fiaya-Emoji-Bounce-Funny-Colorful/dp/B07B8CYTFW.

* cited by examiner

NOVELTY POP-UP TOY ASSEMBLY

TECHNICAL FIELD

This disclosure relates to novelty pop-up toys and similar novelty devices having spring elements that enable the toy to pop up after having been compressed. More particularly, the disclosure relates to novelty pop-up toys having a mesh tubing that can be latched into and unlatched from a compressed state.

BACKGROUND

There is a need for a new structure for novelty pop-up toy assemblies. This disclosure provides a new novelty pop-up toy assembly that meets this need as described and claimed below.

SUMMARY

We provide a pop-up toy assembly comprising a head portion having a cap portion with an interior space, a base portion, and a mesh tubing having a substantially conical or tapered shape with a top end portion and a bottom end portion narrower than the top end portion. The top end is attached to an interior surface of the interior space of the head portion and the bottom end is attached to the base portion. The mesh tubing is configured to invert inwards when a compression force is applied such that the cap portion and the base portion latch together. While in the compressed state, the mesh tubing is primed to spring back open from the compressed state upon impact with an object, e.g., by sliding the toy assembly into another object or obstacle. Upon impact with another object, the cap portion and the base portion unlatch from one another and the mesh tubing is configured to spring back to the uncompressed state with enough force to propel the assembly away from the another object.

DETAILED DESCRIPTION

Examples of pop-up toy assemblies consistent with this disclosure are described below with reference to the figures.

Various configurations have been selected for ease of understanding and illustrated. It should be understood that the configurations are only exemplary and it should be not be considered a limitation on the scope of this disclosure as defined by the claims.

Figure 1:
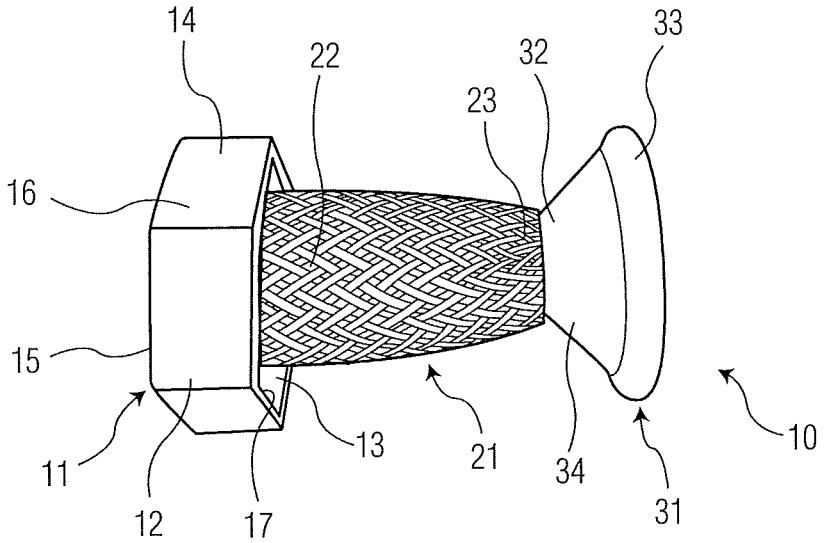
FIG. 1 is a side perspective view of an exemplary pop-up toy assembly in an uncompressed state.
Figure 2:
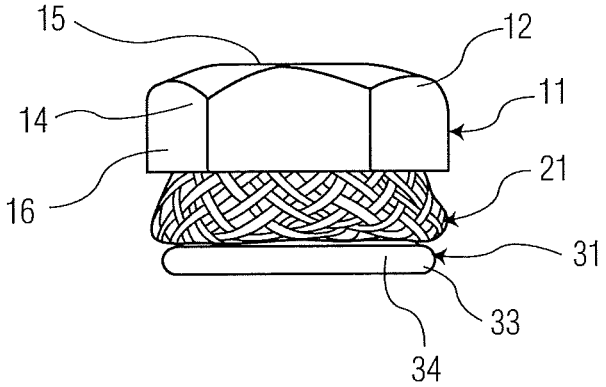
FIG. 2 is a front view of an exemplary pop-up toy assembly latched in a compressed state.
Figure 3:
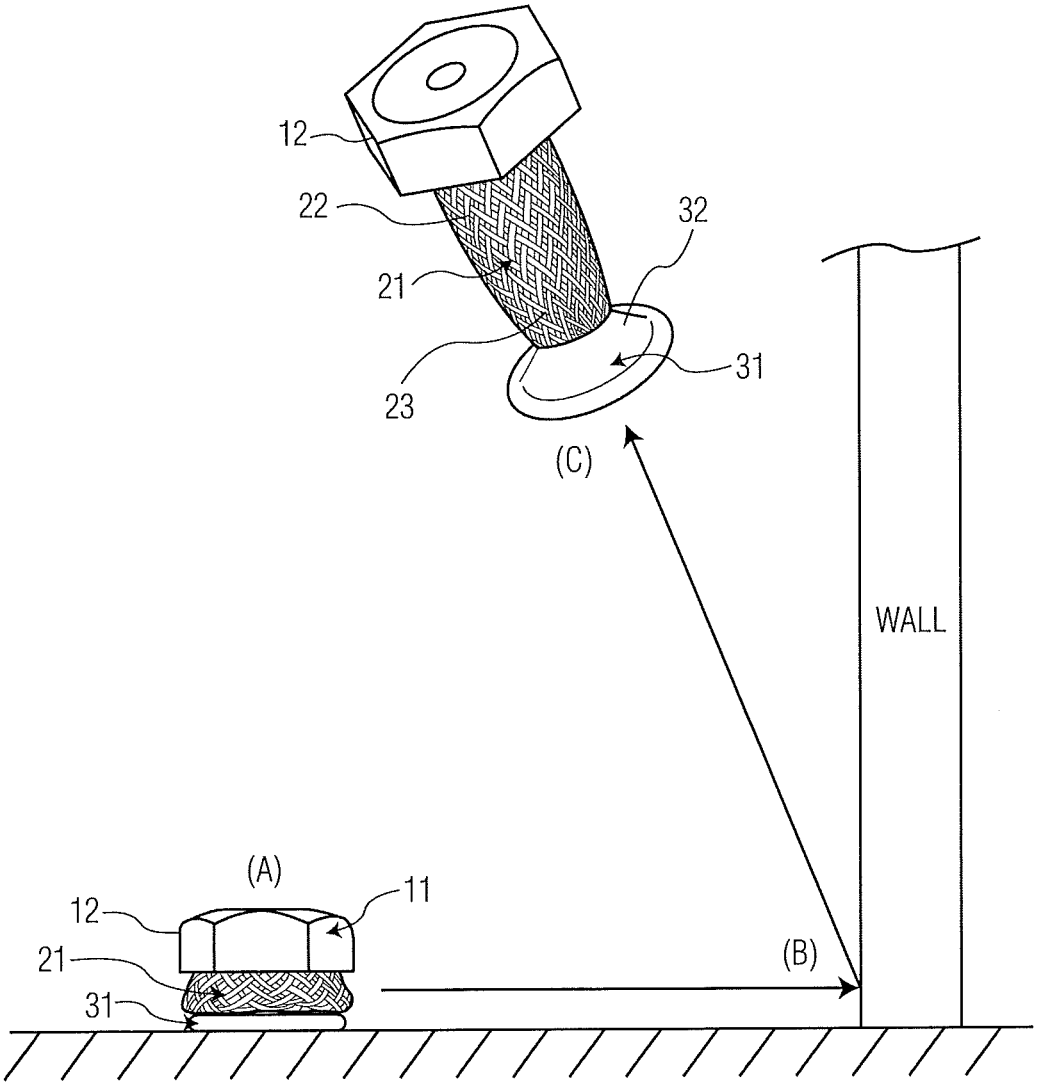
FIG. 3 shows the example of FIGS. 1 and 2 before and after impact with another object and propelled into the air.

FIGS. 1-3 show an exemplary pop-up toy assembly 10 is shown. The assembly 10 includes a head portion 11, a mesh tubing 21, and a base portion 31. The head portion 11 includes a cap portion 12 having an interior space 13. In other words, the cap portion 12 may be substantially hollow and has an open bottom. The cap portion 12 includes an exterior surface 14 with a top surface 15 and a side wall 16 extending downwardly from a perimeter of the top surface 14, defining therein the interior space 13. The interior space 13 is only accessed through the open bottom of the cap portion 12 and includes an interior surface 17 opposite the top surface 15. As illustrated, the cap portion 12 is in a simple hexagonal shape. However, it is understood that that the exterior surface 14 of the cap portion 12 can be formed into many complex shapes such as toy character shapes, cars and the like.

The base portion 31 is preferably in a substantially cone or tapered shape having a narrow top end portion 32 and a wide bottom end portion 33. It is preferable that the diameter of the narrow top end portion 32 of the base portion 31 is different from the diameter of the cap portion 12. More preferably, the diameter of the narrow top end portion 32 of the base portion 31 is smaller than the diameter of the cap portion 12. While the base portion 31 is preferably in a substantially cone or tapered shape, an exterior surface 34 of the base portion 31 can be formed into many complex shapes such as toy character shapes, cars and the like. For example, the base portion 31 can include feet, wheels or the like attached to the wide bottom end portion 33 of the base portion 31. The base portion 31 may be configured to be pushed across or slid along a smooth surface. In this way, the assembly 10 is able to be pushed into impact with another object.

The mesh tubing 21 preferably is a helically woven mesh having a substantially conical or tapered shape including a wide top end portion 22 and a narrow bottom end portion 23. The wide top end portion 22 is attached to the head portion 11 at the interior surface 17 within the interior space 13. Preferably, the wide top end portion 22 of the mesh tubing 21 is attached to the interior surface 17 such that the mesh tubing 21 is substantially concentric with the cap portion 12. In other embodiments, the narrow bottom end portion 23 is attached to the head portion 11 at the interior surface 17 within the interior space 13.

The narrow bottom end portion 23 of the mesh tubing 21 is attached to the base portion 31. As shown in FIG. 1, the narrow bottom end portion 23 of the mesh tubing 21 is attached to the narrow top end portion 32 of the base portion 31. Preferably, the narrow bottom end portion 23 of the mesh tubing 21 is attached to the narrow top end portion 32 of the base portion 31 such that the mesh tubing 21 is substantially concentric with the base portion 31. In other embodiments, the wide top end portion 22 of the mesh tubing 21 is attached to the narrow top end portion 32 of the base portion 31.

Figure 5:
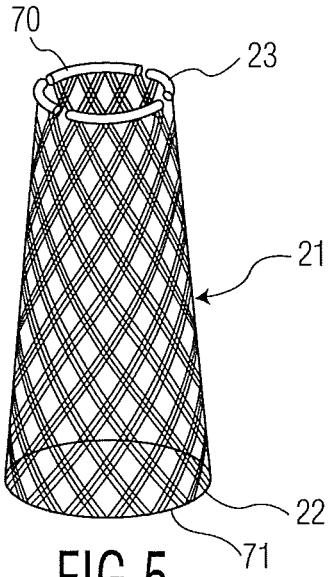
FIG. 5 is a front view of an exemplary mesh tubing for a pop-up toy assembly.
Figure 6:
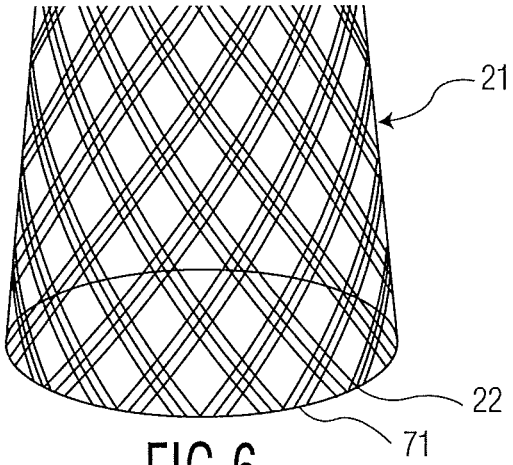
FIG. 6 is a front view of the wide top end of the exemplary mesh tubing.
Figure 7:
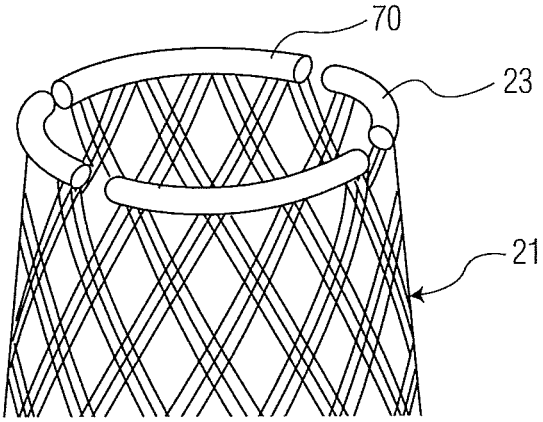
FIG. 7 is a front view of the narrow bottom end of the exemplary mesh tubing.

As shown in FIGS. 5 and 7, the narrow bottom end portion 23 of the mesh tubing 21 includes a molded ring 70 that is broken into four parts to allow the mesh tubing 21 to freely invert. More or fewer parts may be used. As shown in FIGS. 6 and 7, the wide top end portion 22 includes a continuous molded ring 71, which is bonded to an interior surface of the cap portion. The conical appearance of the mesh tubing 21 is due to the different end treatments of the narrow bottom end portion 23 and the narrow top end portion 22.

Referring to FIGS. 1 and 2, it can be seen that, to operate the assembly 10, a compression force is applied downwardly on the head portion 11. As the compression force increases, the mesh tubing 21 inverts inwards such that the cap portion 12 and the base portion 31 latch together so that only a small amount of force is required to keep the mesh tubing 21 in a compressed state. While in the compressed state, the mesh tubing 21 is primed to spring back open from a compressed state upon impact with an object. In other words, a compression force is applied to the head portion 11 of the assembly 10 in an uncompressed state such that an upper portion of the mesh tubing 21 folds over a lower portion of the mesh tubing 21, wherein a latching mechanism removably locks or latches the assembly 10 in a compressed state. The mesh tubing 21 inverting over the lower half of the mesh tubing allows the mesh tubing to form a mushroom-cap shape generally. The mesh tubing 21 preferably comprises polyamide, polyethylene terephthalate or the like to have the mesh tubing 21 fold over itself and latch itself in the compressed state. The mesh tubing 21 also can be made from acrylic material.

As shown in FIG. 3, it can be seen that the assembly 10 is released from the compressed state as shown at location (A) by impact with another object as shown at location (B), which unlocks the latching mechanism. Upon impact, the mesh tubing 21 rapidly returns to its original uncompressed state as shown at location (C). This rapid return to the uncompressed state drives the head portion 11 with enough force to cause the assembly 10 to snap back to its uncompressed state and propel the assembly into air. As discussed above, the assembly 10 can be pushed into impact with another object as the base portion 31 is configured to slide across a smooth surface.

Figure 8:
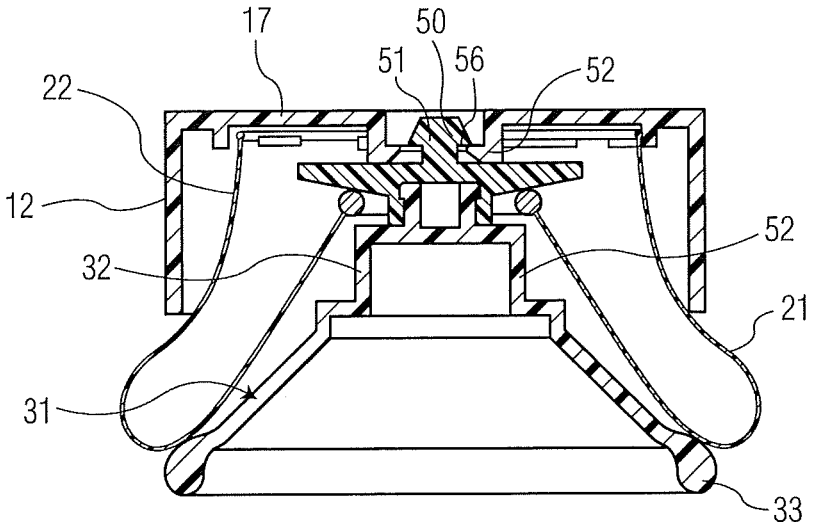
FIG. 8 is a cross-sectional view of the exemplary pop-up toy assembly in a compressed state.
Figure 9:
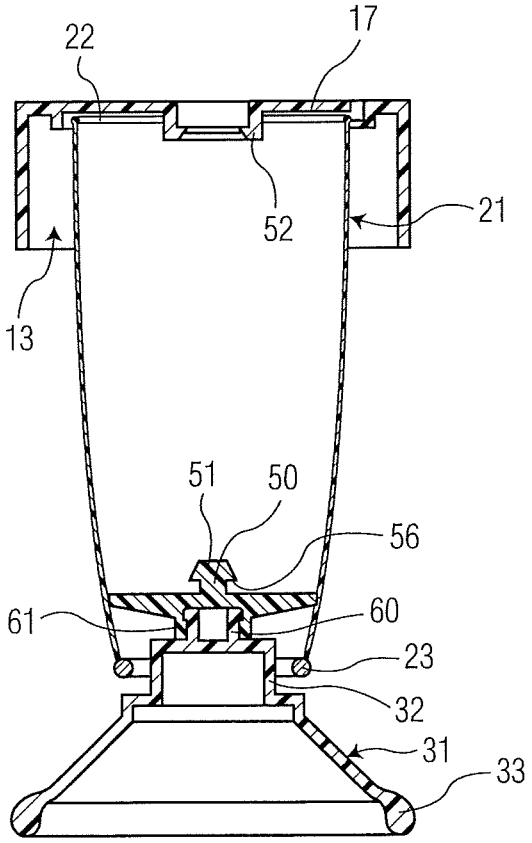
FIG. 9 is a cross-sectional view of the exemplary pop-up toy assembly in an uncompressed state.

As shown in FIGS. 8 and 9, the mesh tubing 21 has a substantially conical or tapered shape, in which the wide top end portion 22 is attached to the cap portion 12 at the interior surface 17 within the interior space 13, and the narrow bottom end portion 23 of the mesh tubing 21 is attached to the narrow top end portion 32 of the base portion 31. The diameter of the cap portion 12 is larger than the narrow top end 32 of the base portion 31. In some examples, the mesh tubing 21 has a length of 40 mm, a diameter of 20 mm at the wide top end portion 22, and a diameter of 11.5 mm at the narrow bottom end portion 23.

The cap portion 12 and the base portion 31 include a latching mechanism 50 configured to latch together the cap portion 12 and the base portion 31 so that only a small amount of force is required to keep the mesh tubing 21 in a compressed state. The latching mechanism 50 includes a male part 51 disposed on the base portion 31 and a female part 52 disposed on the cap portion 12.

Preferably, the male part 51 is disposed on a mesh tube retainer 53 attached to the narrow top end portion 32 of the base portion 31 by snap-fit. The narrow top end portion 32 of the base portion 31 includes a protruding portion 60. The mesh tube retainer 53 includes a snap-in area 61 configured to accept the protruding portion 60 and attach the mesh tube retainer 53 to the base portion 31. The mesh tube retainer 53 preferably has a circular plate shape having a diameter that is slightly larger than the diameter of the narrow bottom end portion 23 of the mesh tubing 21. In this way, the mesh tube retainer 53 is configured to retain the mesh tubing 21 and maintain the connection of the narrow bottom end portion 23 of the mesh tubing 21 to the base portion 31.

Figure 10:
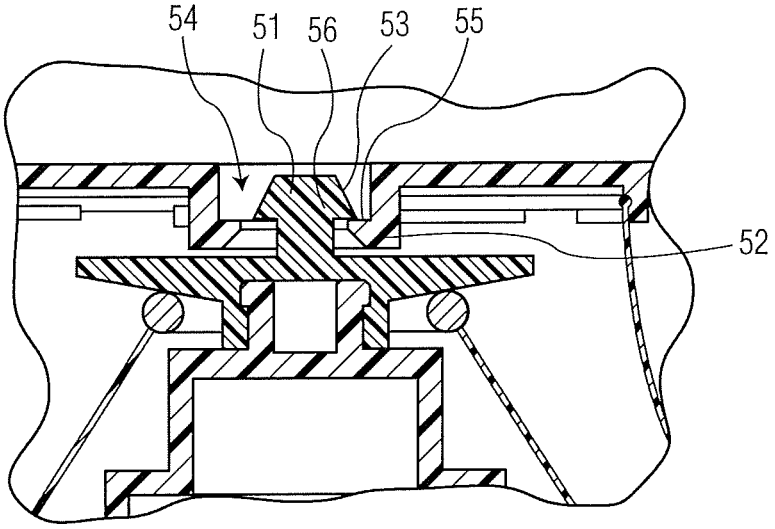
FIG. 10 is a cross-sectional view of the latching mechanism in a latched state.
Figure 11:
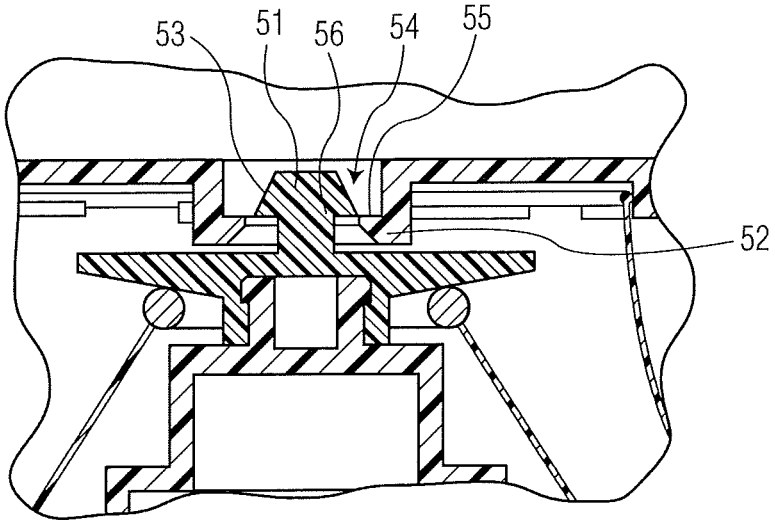
FIG. 11 is a cross-sectional view of the latching mechanism in an unlatched state.

As shown in FIGS. 10 and 11, the male part 51 preferably includes a latching portion 56 with a beveled edge 53. The female portion 52 preferably includes a recess 54 and a receiving edge 55. The female portion 52 is preferably disposed within the interior space 13 of the cap portion 12 as demonstrated in FIG. 9. To removably latch the cap portion 12 to the base portion 31, the latching portion 56 of the male part 51 is received in the recess 54 of the female portion 52. The latching portion of the male part 51 catches onto the receiving edge 55 of the female portion 52 so that the cap portion 12 and the base portion 31 are latched together. In other embodiments, the female part 52 is disposed on the base portion 31 and a male part 51 is disposed within the interior space 13 of the cap portion 12.

These features advantageously allow the latching mechanism to lightly latch the mesh tubing 21 in the compressed state and unlatch through impact with another object. In addition, these features advantageously prevent the mesh tubing 21 from bulging and widening when compressed into the compressed state. The cap portion 12 preferably is pressed slightly at an angle relative to the base portion 31 such that the latching portion 56 catches onto the receiving edge 55 of the female portion 52, thereby latching the cap portion 12 and the base portion 31 together into a compressed state. The cap portion 12 can be unlatched from the base portion 31 by impact. Preferably, the latching portion 56 is released from the receiving edge 55 by impact and the male part 51 extends back through the recess 54 of the female part 52. The unlatching causes the mesh tubing 21 to rapidly return to the uncompressed state, which drives the head portion 11 with enough force to cause the assembly 10 to propel into the air.

The head portion 11 and the base portion 31 can be composed from any suitable plastic or rubber material, or any other lightweight material. The use of lightweight material for the head portion 11 and the base portion 31 enables the assembly 10 to propel upward a significant distance into the air.

Figure 4:
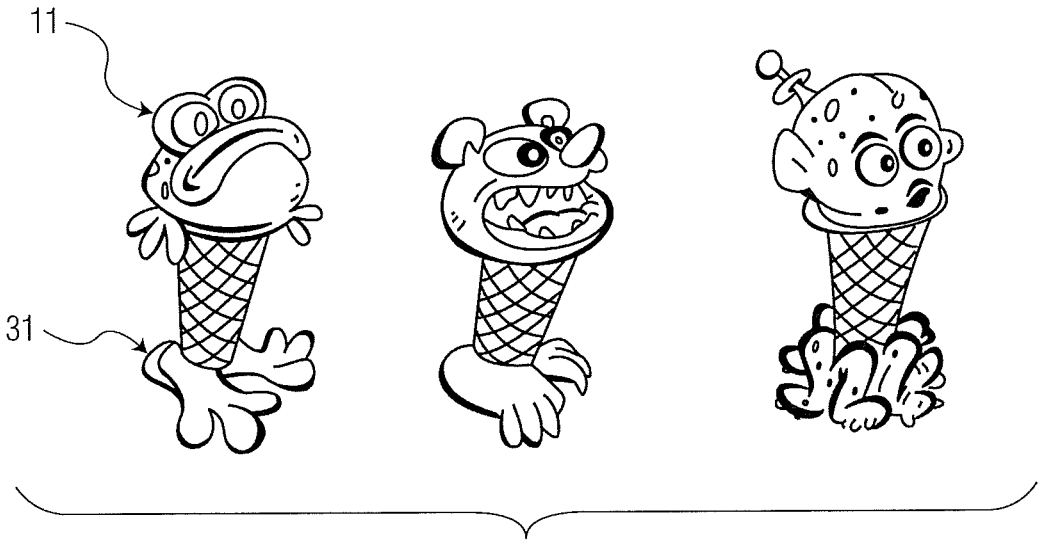
FIG. 4 is a front view of additional exemplary pop-up toy assemblies.

As shown in FIG. 4, exemplary assemblies 10 are shown with exterior surfaces of the head portion 11 and base portion 31 formed into toy character shapes or cars. Toy character shapes include a frog, a dog, and a character riding in a car or a carriage. In some examples, the base portion 31 includes wheels such that the base portion 31 resembles a car. The head portion 11 can also include one or more loose pieces that can be attached to the cap portion 12. The loose pieces are also propelled into the air with the assembly 10 when the mesh tubing 21 releases from the compressed state. The loose pieces can be a variety of items, for example, figures.

Although our apparatus and methods have been described in connection with specific forms thereof, it will be appreciated that a wide variety of equivalents may be substituted for the specified elements described herein without departing from the spirit and scope of this disclosure as described in the appended claims. Additionally, all publications, including but not limited to patents and patent applications, cited in this disclosure are herein incorporated by reference as though fully set forth.

The invention claimed is:

1. A pop-up toy assembly comprising:

a head portion having a cap portion with an interior space, a base portion, a mesh tubing having a top end portion and a bottom end portion narrower than the top end portion, and a latching mechanism, wherein the top end portion is attached to an interior surface of the interior space of the head portion and the bottom end portion is attached to the base portion, the mesh tubing is configured to invert inwards when a compress force is applied to move the assembly from an uncompressed state to a compressed state, and the latching mechanism is configured to latch the head portion and the base portion in a compressed state and, upon impact with another object, the latching mechanism is configured to unlatch from the compressed state and spring back to the uncompressed state with enough force to propel the assembly away from the another object.

2. The assembly according to claim 1, wherein the base portion has a substantially conical or tapered shape.

3. The assembly according to claim 1, wherein the base portion includes a bottom end and a top end narrower than the bottom end.

4. The assembly according to claim 3, wherein the top end of the base portion is attached to the bottom end portion of the mesh tubing.

5. The assembly according to claim 3, wherein the top end of the base portion has a smaller diameter than the cap portion.

6. The assembly according to claim 3, wherein the bottom end of the base portion is configured to slide across a smooth surface.

7. The assembly according to claim 3, wherein the latching mechanism includes a male part disposed on the base portion and a female part disposed on the cap portion.

8. The assembly according to claim 7, wherein the female part is disposed in the interior space of the cap portion.

9. The assembly according to claim 7, wherein the male part is disposed on a mesh tube retainer attached to the top end of the base portion by snap-fit.

10. The assembly according to claim 9, wherein the top end of the base portion includes a protruding portion and the mesh tube retainer includes a snap-in area that is configured to accept the protruding portion and attach the mesh tube retainer to the base portion.

11. The assembly according to claim 7, wherein the male part includes a latching portion with a beveled edge.

12. The assembly according to claim 7, wherein the female part includes a recess and a receiving edge, in which the latching portion is configured to catch onto the receiving edge of the female portion so that the cap portion and the base portion can be removably latched together.

13. The assembly according to claim 3, wherein the latching mechanism includes a male part disposed on the cap portion and a female part disposed on the base portion.

14. The assembly according to claim 1, wherein the mesh tubing is composed from polyamide or polyethylene terephthalate.

15. The assembly according to claim 1, wherein an exterior surface of the cap portion is formed into a toy character shape.

16. The assembly according to claim 1, wherein an exterior surface of the base portion is formed into a car character shape.

17. The assembly according to claim 1, wherein the base portion is configured to slide across a smooth surface.

18. The assembly according to claim 1, wherein the bottom end portion of the mesh tubing includes a molded ring that is broken into four parts to allow the mesh tubing to freely invert.

19. The assembly according to claim 1, wherein the top end portion of the mesh tubing includes a continuous molded ring.

20. The assembly according to claim 1, wherein the mesh tubing has a substantially conical or tapered shape.

* * * * *